United States Patent [19]

Rouillard

[11] Patent Number: 4,861,188

[45] Date of Patent: Aug. 29, 1989

[54] APPARATUS FOR LEVELLING CONCRETE

[75] Inventor: Roger Rouillard, Charlesbourg, Canada

[73] Assignee: Les Placements Paro Inc., Canada

[21] Appl. No.: 20,429

[22] Filed: Mar. 2, 1987

[30] Foreign Application Priority Data

Mar. 5, 1986 [CA] Canada ..... 503,379

[51] Int. Cl.[4] ..... E01C 19/40

[52] U.S. Cl. ..... 404/75; 404/97; 404/114; 404/118

[58] Field of Search ..... 404/118, 119, 101, 102, 404/97, 114, 120, 113, 96, 120; 425/456, 458

[56] References Cited

U.S. PATENT DOCUMENTS

| | | | |
|---|---|---|---|
| 1,955,101 | 4/1934 | Sloan | 404/113 |
| 2,180,198 | 11/1939 | Day | 404/114 |
| 2,255,343 | 9/1941 | Baily | 404/114 |
| 2,303,335 | 12/1942 | Day | 404/102 X |
| 2,314,985 | 3/1943 | Jackson | 404/114 |
| 2,386,662 | 10/1945 | Crock | 404/120 |
| 2,400,321 | 5/1946 | Troxell | 404/120 |
| 2,651,980 | 9/1953 | Wells et al. | 404/113 |
| 2,746,367 | 5/1956 | Ferguson | 404/133 |
| 3,883,259 | 5/1975 | Berg et al. | 404/118 X |
| 4,349,295 | 9/1982 | Morrison | 404/114 |
| 4,375,351 | 3/1983 | Allen | 404/119 X |
| 4,386,901 | 6/1983 | Morrison | 404/118 X |
| 4,408,978 | 10/1983 | Owens | 404/119 X |
| 4,798,494 | 1/1989 | Allen | 404/114 |

*Primary Examiner*—George A. Suchfield
*Assistant Examiner*—Matthew Smith
*Attorney, Agent, or Firm*—Joseph G. Seeber

[57] ABSTRACT

This invention relates to a method and an apparatus for compacting and smoothing freshly poured concrete during the construction of a floor or other flat surface. The apparatus is a screed divided in two portions. The first portion is used to level, compact and remove excess concrete and the second portion allows the screed to float on the freshly poured and soft concrete.

12 Claims, 2 Drawing Sheets

APPARATUS FOR LEVELLING CONCRETE

FIELD OF THE INVENTION

The present invention relates to a method and an apparatus for compacting and smoothing concrete during the construction of a floor.

BRIEF DESCRIPTION OF THE PRIOR ART

There exists, on the market, a rapidly increasing number of screeds for compacting or compactng and leveling concrete during the construction of a floor.

Among existing compacting apparatuses, we find those described in U.S. Pat. Nos. 1,955,101 (Sloan) and 2,746,367 (Ferguson). The principal characteristics of these apparatuses are the use of a relatively large surface and a mechanism to generate vibrations.

Other patents describe screeds to level concrete. For example, U.S. Pat. Nos. 2,314,985 (Jackson), 2,255,343 (Baily), 4,386,901 (Morrison) and 4,349,295 (Morrison). The common characteristic of these apparatuses is that they have at least one elongated piece, generally an angle or a channel which is used to level the concrete. This elongated piece is a descendant of the wooden screeds well known to those skilled in the art. This piece must have at least two perpendicular plane surfaces relative to each other so as to form a corner. One of these surfaces is used to level the concrete while the other, placed perpendicularly to the first one, is used to push away the excess concrete.

Each of these apparatuses is also characterized by the presence of means to facilitate the task of the operative.

Thus, Baily presents a mechanism for oscillating the pushing side of the piece to push away the excess concrete. In addition, Baily's screed must be installed on a metal frame, such as a channel, which runs along each side of the surface to be covered by concrete.

Jackson's screed is provided with a system to generate vibrations. In opposition to Baily's screed, it does not require a rigid frame. However, it must be supported by two workers who must exercise care to prevent the screed from sinking in the cement.

Morrision, in his first patent, uses a triangular truss, (when seen in a cross section), which can be divided in at least three parts. Morrison's screed is also provided with pneumatic vibrators and a pneumatic displacement system. As Baily's screed, it requires that metal supports surround the surface to be covered by concrete. Therefore, the worker does not need to support or to pull the screed during the leveling process. The improvement which Morrison made to his screed and which is the subject of this second patent is that either by decreasing the dimensions of his first screed and by providing handles, the screed does not require metal supports. However, the screed must be supported by the workers.

However, each of these screeds has the disadvantage that either it requires a support surrounding the surface to be covered or it must be supported by at least two workers.

OBJECTS OF THE INVENTION

An object of the invention is to supply to the construction industry a screed allowing for the precise leveling of concrete, the screed comprising vibrating means for compacting the concrete, and the screed not requiring a rigid support nor to be supported by workers.

The latter object is obtained by building a screed in two sections. The first section is built from an angle or other section which supports pneumatic vibrators. The second section, which we have named the floater, is built from a sheet of any appropriate material which is large enough to permit the entire structure to float on the freshly poured concrete. Thus, the entire weight of the screed is transmitted to the floater and thus avoids the need for the screed to be supported by a frame or workers.

It is preferable to use lightweight materials so that the size of the floater will be acceptable.

DESCRIPTION OF A PREFERRED EMBODIMENT

Figure 1:
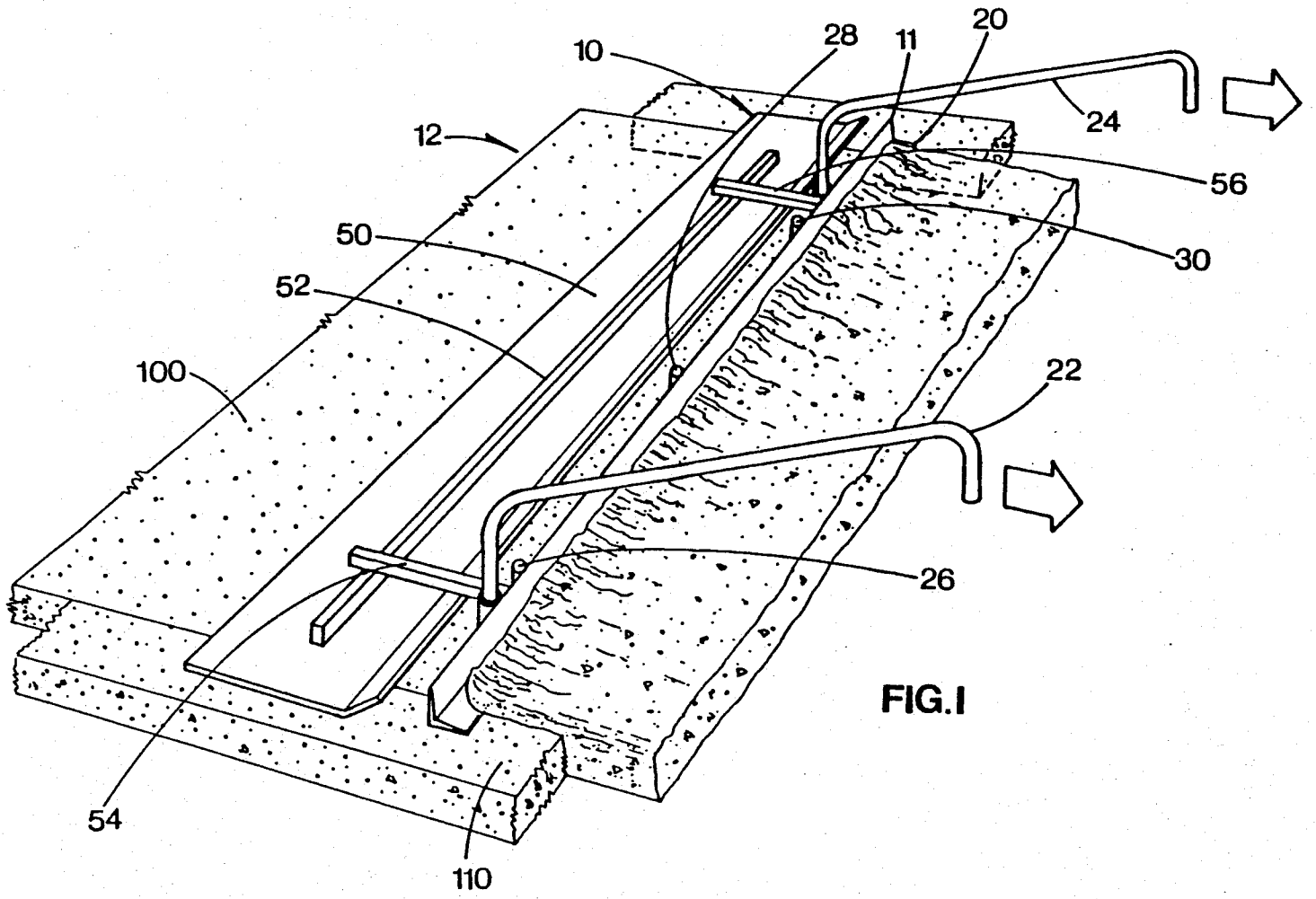
FIG. 1 illustrates a perspective view of one embodiment of the invention when in use.
Figure 3:
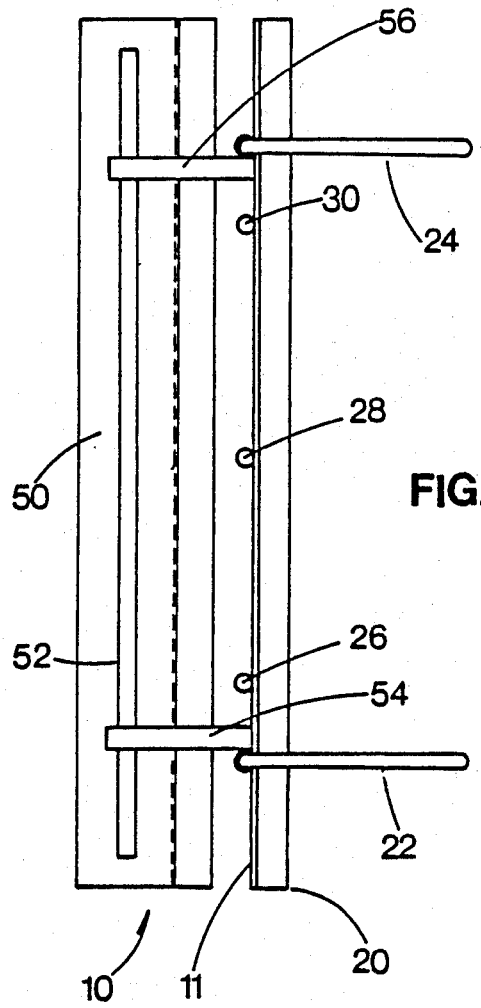
FIG. 3 is a top view of the embodiment shown in FIG. 1.
Figure 2:
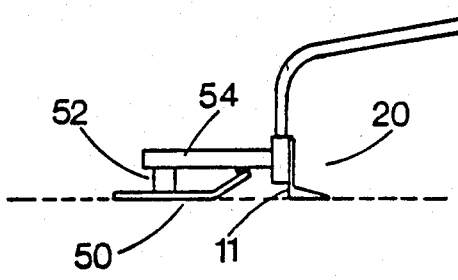
FIG. 2 is a side view of the embodiment shown in FIG. 1.

As presented in FIGS. 1 to 3, the screed 10 comprises two sections. The first section 11 of the screed 10 comprises an angle 20 of the desired length, in this case, of approximately 10 feet to which are attached two handles 22 and 24 and three pneumatic vibrators 26, 28 and 30. The second section 12 comprises a metal sheet 50 having a length, which corresponds to that of the angle, and a width which are adequate to produce a surface which will insure that the entire weight of the structure will float on the fresh concrete.

A support 52 is installed on sheet 50 to increase the rigidity of the sheet 50 and allow the attachment of two other supports 54 and 56 which join sections 11 and 12 together and transmit the weight of section 11 to section 12.

To obtain maximum efficiency the workers using this screed must use the following method.

Firstly, concrete is poured and manually levelled according to techniques which are well known to those skilled in the art, to form two concrete guides 110 and 120. The concrete required to fill the void between the two guides 110 and 120 is then poured and leveled with a rake. The next step is to use the screed to level concrete.

The effort that the worker must supply to manipulate this screed when compared to known screeds is reduced considerably because the worker is simply required to pull the screed and to check that angle 20 does not sink into guides 110 and 120. The pouring time is also considerably reduced because the simplicity of the device eliminates installation time, which is usually necessary especially when using larger screeds.

One further advantage of this screed compared to those already on the market is that not only good compaction of the concrete is achieved due to the vibrations and a reduction of the efforts, and/or of the time usually required to place the concrete is obtained, but also the rough finish which is obtained after the passage of the screed is of superior quality due to the smooth surface of the floater.

Even if the invention has been described by using a preferred embodiment, it should not be limited to same. It is clear that various additions or modifications and other changes may be effected without departing from the scope of the invention as described and claimed herein.

I claim:

1. A screed for levelling concrete or other similar material, comprising:

(a) a first section comprising first means for levelling and compacting the concrete or similar material, and second means for removing excess concrete;

(b) a second flat section operatively associated with said first section and including third means comprising a plane surface of sufficient area for causing the screed to float on the freshly poured concrete; and (c) displacing means secured to said screed for displacing said screed so that said first section is used as a front section of said screed and said second section is used as a rear section of said screed, said front section passing over the concrete prior to said rear section passing over the concrete.

2. A screed according to claim 1, wherein the first section comprises a vibrator, said first means comprises a portion presenting a first surface parallel to the surface which is to be levelled, and said second means comprises a second surface which is perpendicular to the first surface.

3. A screed according to claim 2, wherein the displacing means are handles.

4. A screed according to claim 2, wherein the first section is separated from the second section.

5. A screed according to claim 1, wherein the displacing means are handles.

6. A screed according to claim 5, wherein the first section is separated from the second section.

7. A screed according to claim 1, wherein the first section is separated from the second section.

8. A method for compacting and levelling a concrete surface, comprising the steps of:

(a) pouring and hand levelling two freshly poured concrete strips;

(b) filling with concrete the volume comprised between the two strips, said strips defining sides of said concrete surface;

(c) roughly levelling the concrete surface;

(d) providing a screed which comprises a first section having first means for levelling and compacting the concrete surface and second means for removing excess concrete, and a second flat section operatively associated with said first section and including third means comprising a plane surface of sufficient area for causing the screed to float on the concrete surface; and (e) moving the screed on said two freshly poured concrete strips by displacing the screed so that said first section is used as the front section of said screed and said second section is used as the rear section of said screed.

9. The method of claim 8, wherein said step (d) comprises providing said first section of said screed with a vibrator, said first means comprising a portion presenting a first surface parallel to the surface which is to be levelled, and said second means comprising a portion presenting a second surface which is perpendicular to the first surface.

10. The method of claim 9, wherein said step (d) comprises disposing said first section of said screed separate from said second section of said screed, and said step (e) comprises using handles to displace the screed.

11. The method of claim 8, wherein said step (e) comprises using handles to displace the screed.

12. The method of claim 8, wherein said step (d) comprises disposing said first section of said screed separate from said second section of said screed.

* * * * *